US009365069B2

(12) United States Patent
Kawai

(10) Patent No.: US 9,365,069 B2
(45) Date of Patent: Jun. 14, 2016

(54) POST-PROCESSING APPARATUS AND IMAGE FORMING SYSTEM

(71) Applicant: KONICA MINOLTA, INC., Chiyoda-ku, Tokyo (JP)

(72) Inventor: Atsushi Kawai, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 15 days.

(21) Appl. No.: 14/468,005

(22) Filed: Aug. 25, 2014

(65) Prior Publication Data

US 2015/0063952 A1 Mar. 5, 2015

(30) Foreign Application Priority Data

Sep. 4, 2013 (JP) ..... 2013-183079

(51) Int. Cl.
*B42C 11/04* (2006.01)
*B65H 7/20* (2006.01)
(Continued)

(52) U.S. Cl.
CPC . *B42C 11/04* (2013.01); *B42B 2/02* (2013.01); *B42B 4/00* (2013.01); *B42C 1/12* (2013.01); *B42C 7/005* (2013.01); *B42C 9/0006* (2013.01); *B42C 19/02* (2013.01); *B65H 7/20* (2013.01); *B65H 15/00* (2013.01); *B65H 37/04* (2013.01); *B65H 45/12* (2013.01); *B65H 45/30* (2013.01); *G03G 15/6573* (2013.01); *G03G 21/16* (2013.01); *B65H 2301/332* (2013.01); *B65H 2301/333* (2013.01);
(Continued)

(58) Field of Classification Search
CPC ..... B42C 11/04; B31F 5/003; B65H 45/12; B65H 15/00; B65H 37/04; B65H 2801/27; B65H 2301/332; B65H 2301/333
USPC ..... 270/37, 45, 58.07, 58.08; 271/186; 412/19; 493/405
See application file for complete search history.

(56) References Cited

U.S. PATENT DOCUMENTS 7,980,542 B2 * 7/2011 Kawata et al. ..... 270/37
8,128,088 B2 * 3/2012 Suh et al. ..... 271/288
(Continued)

FOREIGN PATENT DOCUMENTS

JP 2007320713 A 12/2007
JP 2009166915 A 7/2009
(Continued)

OTHER PUBLICATIONS

Japanese Office Action (and English translation thereof) dated Aug. 5, 2015, issued in counterpart Japanese Application No. 2013-183079.

*Primary Examiner* — Leslie A Nicholson, III
(74) *Attorney, Agent, or Firm* — Holtz, Holtz & Volek PC

(57) ABSTRACT

The present invention includes a first post-processor equipped with a paper turn-over unit for paper and a paper surface processing unit adapted to process a paper surface of the paper; a second post-processor configured to be different from the first post-processor and located downstream of the first post-processor in a paper transport direction; and a controller adapted to control the first post-processor and the second post-processor, wherein the controller determines whether to use the paper turn-over unit, according to a combination of a post-processing mode which uses the first post-processor and a post-processing mode which uses the second post-processor.

12 Claims, 9 Drawing Sheets

(51) Int. Cl.

| | |
|---|---|
| ***B65H 45/12*** | (2006.01) |
| ***B65H 37/04*** | (2006.01) |
| ***B65H 15/00*** | (2006.01) |
| ***B42B 2/02*** | (2006.01) |
| ***B42B 4/00*** | (2006.01) |
| ***B42C 1/12*** | (2006.01) |
| ***B42C 7/00*** | (2006.01) |
| ***B42C 9/00*** | (2006.01) |
| ***B42C 19/02*** | (2006.01) |
| ***G03G 21/16*** | (2006.01) |
| ***B65H 45/30*** | (2006.01) |
| *G03G 15/00* | (2006.01) |

(52) U.S. Cl.

CPC .. *B65H 2301/4381* (2013.01); *B65H 2511/414* (2013.01); *B65H 2511/415* (2013.01); *B65H 2801/27* (2013.01); *G03G 15/6544* (2013.01); *G03G 2215/007* (2013.01); *G03G 2215/00822* (2013.01); *G03G 2215/00848* (2013.01); *G03G 2215/00877* (2013.01); *G03G 2215/00936* (2013.01); *G03G 2221/1696* (2013.01)

(56) References Cited

U.S. PATENT DOCUMENTS

| | | | | |
|---|---|---|---|---|
| 8,974,360 | B2 * | 3/2015 | Musha | 493/405 |
| 9,022,388 | B2 * | 5/2015 | Nonaka | 271/288 |
| 2011/0081185 | A1 * | 4/2011 | Motoi et al. | 399/407 |
| 2012/0021884 | A1 * | 1/2012 | Musha | 493/405 |
| 2014/0159306 | A1 * | 6/2014 | Nonaka | 271/288 |

FOREIGN PATENT DOCUMENTS

| | | | |
|---|---|---|---|
| JP | 2011073869 | A | 4/2011 |
| JP | 2011111270 | A | 6/2011 |
| JP | 2012041187 | A | 3/2012 |
| JP | 2012158473 | A | 8/2012 |

* cited by examiner

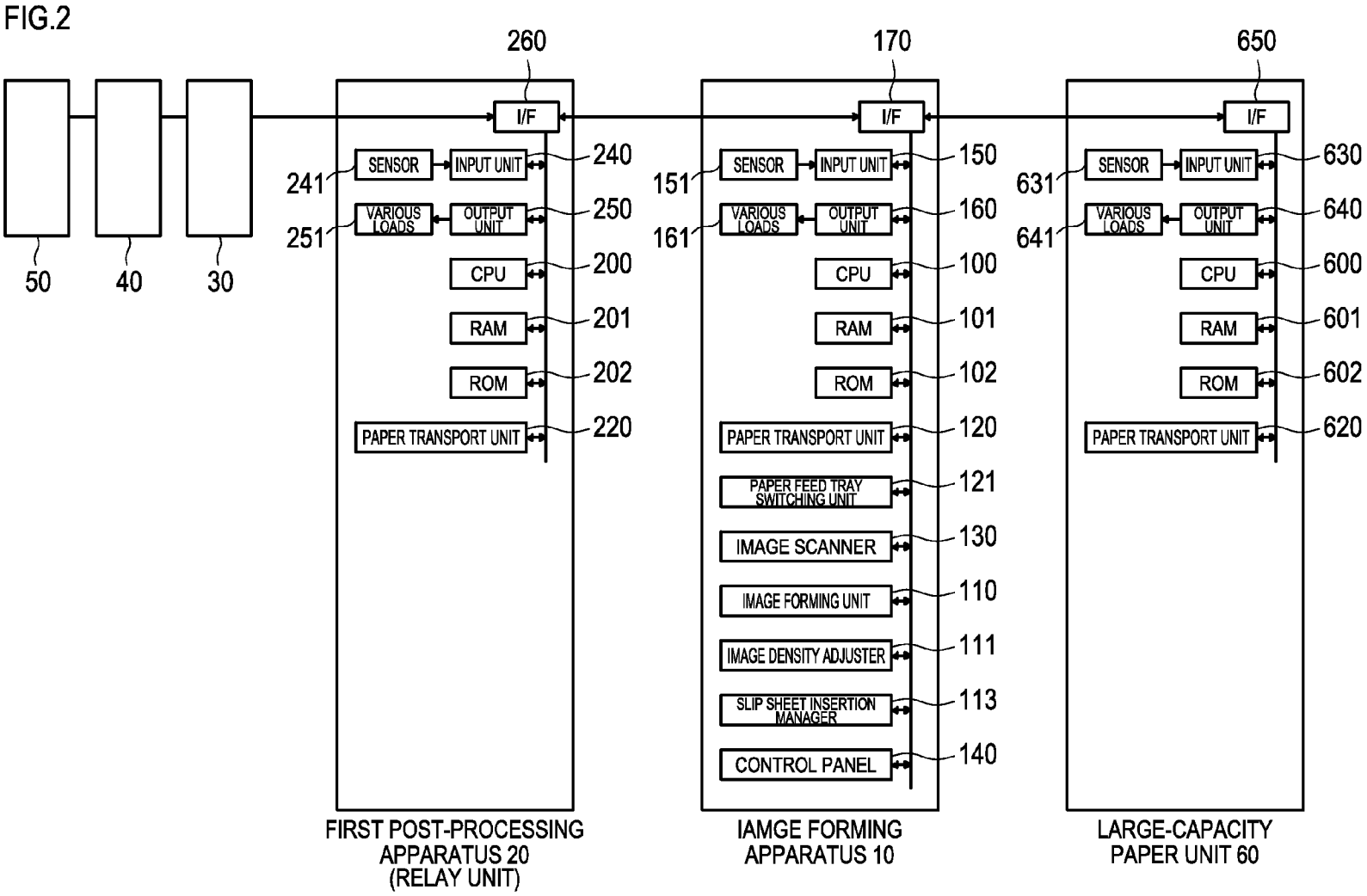
FIG.2
50
40
30
260
I/F
INPUT UNIT
OUTPUT UNIT
CPU
RAM
ROM
PAPER TRANSPORT UNIT
SENSOR
VARIOUS LOADS
240
250
200
201
202
220
241
251
FIRST POST-PROCESSING APPARATUS 20 (RELAY UNIT)
170
I/F
INPUT UNIT
OUTPUT UNIT
CPU
RAM
ROM
PAPER TRANSPORT UNIT
PAPER FEED TRAY SWITCHING UNIT
IMAGE SCANNER
IMAGE FORMING UNIT
IMAGE DENSITY ADJUSTER
SLIP SHEET INSERTION MANAGER
CONTROL PANEL
SENSOR
VARIOUS LOADS
150
160
100
101
102
120
121
130
110
111
113
140
151
161
IAMGE FORMING APPARATUS 10
650
I/F
INPUT UNIT
OUTPUT UNIT
CPU
RAM
ROM
PAPER TRANSPORT UNIT
SENSOR
VARIOUS LOADS
630
640
600
601
602
620
631
641
LARGE-CAPACITY PAPER UNIT 60

POST-PROCESSING APPARATUS AND IMAGE FORMING SYSTEM

CROSS-REFERENCE TO RELATED APPLICATIONS

The present application claims priority under 35 U.S.C. §119 to Japanese Patent Application No. 2013-183079, filed Sep. 4, 2013. The contents of this application are incorporated herein by reference in their entirety.

BACKGROUND OF THE INVENTION

1. Field of the Invention

The present invention relates to a paper post-processing apparatus and image forming system equipped with a paper turn-over unit.

2. Description of the Related Art

An image forming system is provided which allows various types of post-processing to be performed on paper by a post-processing apparatus after an image is formed on the paper by an image forming apparatus.

Some paper used in image formation and post-processing has different textures on front and back sides, for example, with the front side being glossy and back side being non-glossy, and there is sometimes a desire to obtain an output in which all sheets are oriented in the same direction with their front side turned in one direction and their back side turned in the other direction in a binding process and the like.

For example, Japanese Patent Laid-Open No. 2011-73869 proposes an image forming apparatus, post-processing apparatus, and image forming system which perform display control so as to display a message, asking a user to place a cover anew in a direction opposite a direction in which the cover is placed in a binding processing mode.

Also, Japanese Patent Laid-Open No. 2007-320713 proposes a sheet folding apparatus and image forming system which turn over paper using a paper turn-over unit of an insert apparatus according to a folding mode setting in post-processing when inserting insert paper.

However, when plural post-processors are provided, if post-processing which involves turning over a paper is carried out in a post-processor of a preceding stage, there is a problem in that the front side and back side of the output paper obtained in a post-processor of a succeeding stage are reversed depending on whether the post-processor of the preceding stage is used or not.

For example, a post-processor which performs a creasing process is known as a post-processor which includes a paper turn-over unit. In this case, the paper is creased by being passed through an inversion path and after the creasing, the paper is transported downstream with its front and back sides reversed from when introduced into the post-processor.

Post-processing which involves a creasing process in this way is sometimes used in combination with other types of post-processing. For example, there is demand to form lines on a cover before case binding using a creasing unit in order to make it easy to fold a corner between cover and spine in case binding. In so doing, if the papers are turned over only when creases are provided, the front and back sides of the cover are reversed depending on whether creases are present or absent. That is, in case binding, the side on which a fold is formed is reversed depending on whether creases are present or absent.

Paper turn-over operations, which involve productivity reduction and paper size constraints, are desirably avoided unless necessary. If paper is not turned over by a paper turn-over unit, it becomes necessary instead for the user to turn over and set the paper contained in a paper feed cassette.

In contrast, Japanese Patent Laid-Open No. 2011-73869 described above simply displays a message on a panel, prompting the user to turn over the paper, but does not reduce the labor of turning over the paper.

Also, since Japanese Patent Laid-Open No. 2007-320713 assumes the use of the paper turn-over unit of the insert apparatus, the paper cannot be turned over if such an apparatus is not available. Also, it is only possible to reverse the front and back sides of the insert paper, and it is not possible to reverse the front and back sides of the paper subjected to post-processing automatically according to details of post-processing.

SUMMARY OF THE INVENTION

The present invention has been made in view of the above circumstances and has at least one object to provide a post-processing apparatus and image forming system which not only enables various combinations of post-processes, but also allows outputs to be easily produced with the same side of all papers facing the same direction as required.

To achieve at least one of the abovementioned objects, a post-processing apparatus reflecting one aspect of the present invention comprise a post-processing apparatus according to a first present invention comprises: a first post-processor equipped with a paper turn-over unit for paper and a paper surface processing unit adapted to process a paper surface of the paper; a second post-processor configured to be different from the first post-processor and located downstream of the first post-processor in a paper transport direction; and a controller adapted to control the first post-processor and the second post-processor, wherein the controller determines whether to use the paper turn-over unit, according to a combination of a post-processing mode which uses the first post-processor and a post-processing mode which uses the second post-processor.

In the post-processing apparatus according to the abovementioned aspect, it is preferable that, after the paper surface of the paper has been processed by the paper surface processing unit, the first post-processor transports the paper downstream by reversing front and back sides of the paper using the paper turn-over unit.

In the post-processing apparatus according to the abovementioned aspect, it is preferable that the paper surface processing unit is a creasing unit adapted to form a line on a front side of the paper.

In the post-processing apparatus according to the abovementioned aspect, it is preferable that the second post-processor performs post-processing including folding of the paper.

In the post-processing apparatus according to the abovementioned aspect, it is preferable that the second post-processor performs any of case binding cover, middle folding, and saddle stitching processes.

In the post-processing apparatus according to the abovementioned aspect, it is preferable that, when the second post-processor performs post-processing including the folding of the paper, the controller uses the paper turn-over unit regardless of whether the paper surface processing unit is operated, and when the second post-processor performs post-processing without including the folding of the paper, the controller uses the paper turn-over unit only when the paper surface processing unit is operated.

To achieve at least one of the abovementioned objects, an image forming system reflecting one aspect of the present invention comprises: an image forming apparatus adapted to form an image on paper; a first post-processor equipped with a paper turn-over unit for paper and a paper surface processing unit adapted to process a paper surface of the paper; a second post-processor configured to be different from the first post-processor and located downstream of the first post-processor in a paper transport direction; and a controller adapted to control the first post-processor and the second post-processor, wherein the controller determines whether to use the paper turn-over unit of the first post-processor, according to a combination of a post-processing mode which uses the first post-processor and a post-processing mode which uses the second post-processor.

In the image forming system according to the above-mentioned aspect, it is preferable that, after the paper surface of the paper has been processed by the paper surface processing unit, the first post-processor transports the paper downstream by reversing front and back sides of the paper using the paper turn-over unit.

In the image forming system according to the above-mentioned aspect, it is preferable that the paper surface processing unit of the first post-processor is a creasing unit adapted to form a line on a front side of the paper.

In the image forming system according to the above-mentioned aspect, it is preferable that the second post-processor performs post-processing including folding of the paper.

In the image forming system according to the above-mentioned aspect, it is preferable that the second post-processor performs any of case binding cover, middle folding, and saddle stitching processes.

In the image forming system according to the above-mentioned aspect, it is preferable that, when the second post-processor performs post-processing including the folding of the paper, the controller uses the paper turn-over unit regardless of whether the paper surface processing unit is operated, and when the second post-processor performs post-processing without including the folding of the paper, the controller uses the paper turn-over unit only when the paper surface processing unit is operated.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

FIG. 2 is a diagram showing part of functional blocks of the image forming system according to the embodiment of the present invention;

DETAILED DESCRIPTION OF THE PREFERRED EMBODIMENTS

Figure 1:
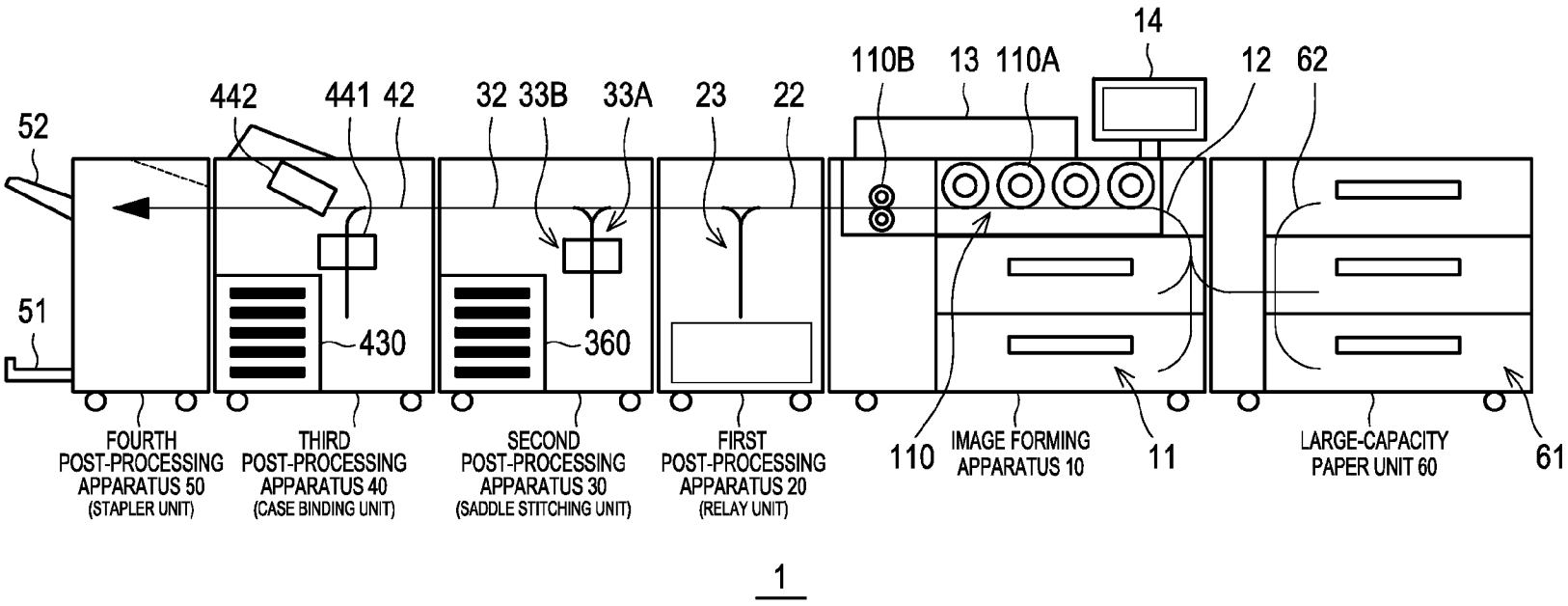
FIG. 1 is a diagram showing a mechanical outline of an image forming system according to an embodiment of the present invention.

Hereinafter, an embodiment of the present invention will be described with reference to the drawings. However, the scope of the invention is not limited to the illustrated examples.

A post-processing apparatus and image forming system according to an embodiment of the present invention will be described below with reference to the accompanying drawings.

The image forming system 1 includes an image forming apparatus 10, a first post-processing apparatus 20, a second post-processing apparatus 30, a third post-processing apparatus 40, and a fourth post-processing apparatus 50, which are connected mechanically and electrically along a paper transport direction. Also, a large-capacity paper unit 60 is connected mechanically and electrically on an upstream side of the image forming apparatus 10 in a transport direction.

Of the post-processing apparatus, the first post-processing apparatus 20 is a unit adapted to transport stacked sheets of paper downstream and the second post-processing apparatus 30 is a unit adapted to perform creasing and saddle stitching. The third post-processing apparatus 40 is a unit adapted to perform case binding and the fourth post-processing apparatus 50 is a unit adapted to perform stapling and paper discharge.

The large-capacity paper unit 60 is capable of containing a large volume of paper and feeding the paper to the image forming apparatus 10.

The large-capacity paper unit 60 is equipped with a multiple tiers of paper feed trays 61 and is able to feed and transport paper from a predetermined paper feed tray 61 to the image forming apparatus 10 via a transport path 62 on instructions from the image forming apparatus 10.

The image forming apparatus 10 has an automatic document feeder (ADF) 13 provided on an upper body side, where the automatic document feeder 13 is adapted to feed paper automatically.

A document fed by the automatic document feeder (ADF) 13 is designed to be able to be scanned by an image scanner 130 shown in FIG. 2. Note that the document can be scanned through a glass platen (not shown).

Also, on the upper body side of the image forming apparatus 10, an LCD 14 making up part of a control panel 140 is installed in a place where the glass platen is not located. The control panel 140 includes a control panel controller adapted to control the LCD 14.

The LCD 14 is made up of a touch panel and configured to be able to display operator actions and information. The LCD 14 allows both operation and display. Note that the control panel can be configured with a mouse, tablet and like etc., and configured separately from a display unit. Also, the LCD 14 can be configured to be movable.

Furthermore, plural paper feed trays 11 (two tiers in FIG. 1) are installed on a lower body side of the image forming apparatus 10.

A transport path 12 is provided in the image forming apparatus 10 to transport the paper fed from the large-capacity paper unit 60 or any of the paper feed trays 11 to the first post-processing apparatus 20.

An image forming unit 110 is provided midway along the transport path 12. In the image forming unit 110, photosensitive bodies 110A for different colors (cyan, magenta, yellow, black) are arranged in tandem and an electrostatic charger, LD, developing device, and transfer unit (none is shown) are placed around each photosensitive body 110A. Furthermore, a fuser 110B is placed on the transport path 12 downstream of the photosensitive bodies 110A.

The transport path 12 is connected to a transport path 22 of the first post-processing apparatus 20 on a downstream side of the fuser 110B.

In the image forming unit 110, before an image is written, a surface of the photosensitive body 110A for each color is charged uniformly by the electrostatic charger, and the photosensitive body 110A whose surface is uniformly charged is irradiated with a semiconductor laser by the LD, thereby forming an electrostatic latent image on the photosensitive body 110A. The electrostatic latent image formed on the photosensitive body 110A by the LD is developed with a toner member by the developing device. A toner image is formed on the photosensitive body 110A by the developing process. The toner image is transferred from the photosensitive body 110A by the transfer unit onto the paper transported from the paper feed tray 11. The paper with the toner image transferred thereto is separated from the photosensitive body 110A and transported to the fuser 110B. The toner member remaining on the photosensitive body 110A is removed by a cleaning unit (not shown). A color image or monochrome image is formed on the paper as the paper passes through the photosensitive bodies 110A for different colors arranged in tandem.

By heating the transported paper, the toner images transferred to the front side of the paper is fixed as an output image by the fuser 110B. After the fixing process, the paper is either transported to the first post-processing apparatus 20 along the transport path 12, or turned over via an inversion transport path (not shown), returned to the transport path 12 on the upstream side of the image forming unit 110, and an image is formed on the back side.

The first post-processing apparatus 20 functions as a relay unit between the image forming apparatus 10 and a post-processing apparatus on the side of a succeeding stage.

The first post-processing apparatus 20 is provided with the transport path 22, which is equipped with a stacker 23 adapted to transport paper by stacking up to a predetermined number of sheets. For example, the stacker 23 can transport paper by stacking up to two papers or transport the paper directly without stacking. The stacker absorbs a productivity difference between the image forming apparatus and post-processing apparatus and allows the post-processing apparatus having low productivity to operate by being connected with the image forming apparatus having high productivity.

The second post-processing apparatus 30 has a creasing function and functions as a saddle stitching unit.

A transport path 32, a paper turn-over unit 33A, and a creasing section 33B are illustrated in FIG. 1. In the present embodiment, the creasing unit corresponds to a paper surface processing unit according to the present invention, and the paper turn-over unit 33A and creasing section 33B correspond to a first post-processor according to the present invention.

The paper surface processing unit post-process the papers and is not a unit in which only the paper is turned over as a post-processing.

The third post-processing apparatus 40 functions as a case binding unit; and a paper transport path 42, a cover binding unit 441, and a booklet thickness measuring unit 442 are provided in the third post-processing apparatus 40 as illustrated in FIG. 1.

The fourth post-processing apparatus 50 functions as a stapling unit; and a bundle catcher 51 to be adapted to catch bundles and a paper output tray 52 are provided in the fourth post-processing apparatus 50 as illustrated in FIG. 1.

Figure 3:
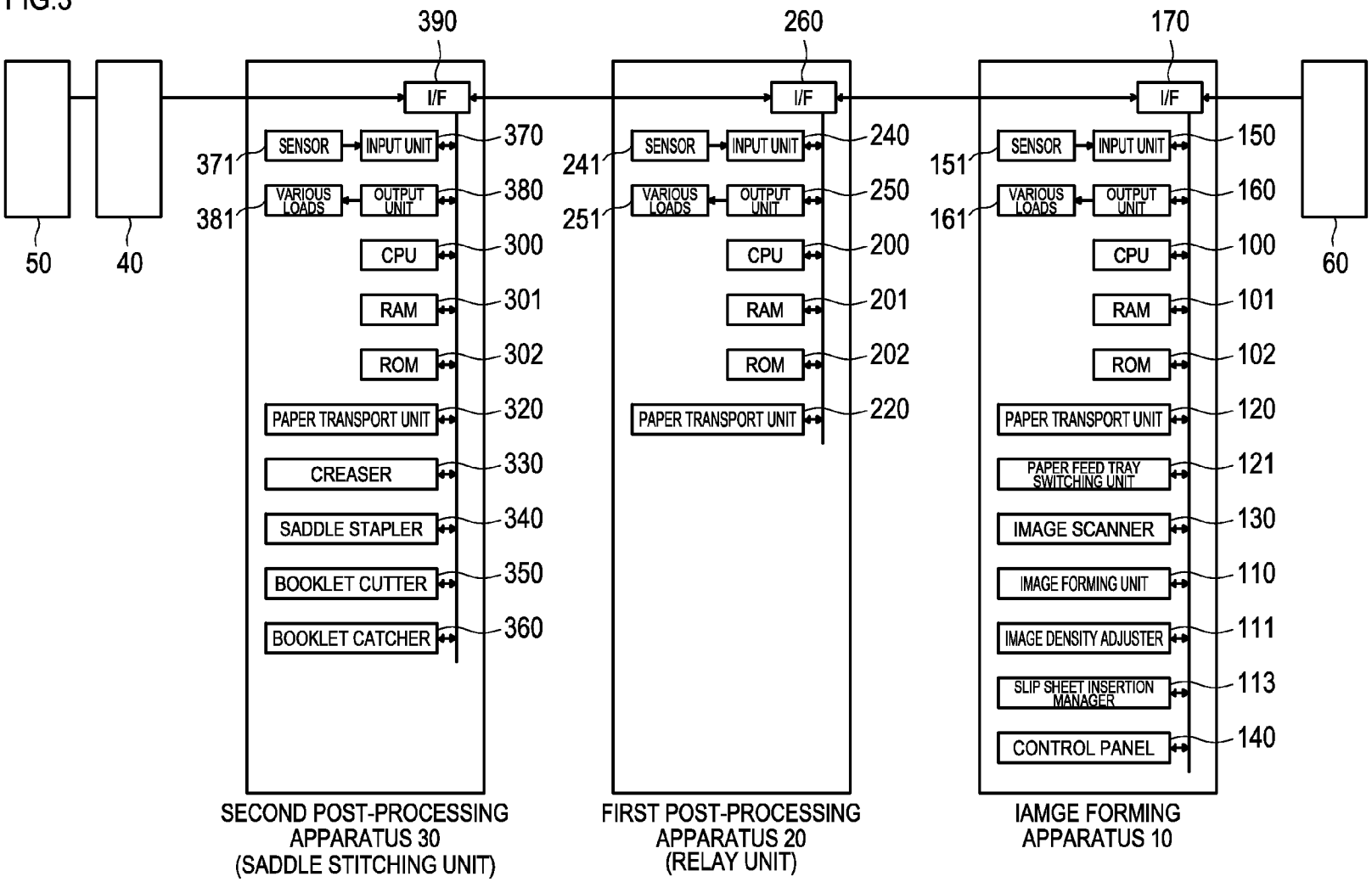
FIG. 3 is a diagram showing part of the functional blocks of the image forming system according to the embodiment of the present invention.
Figure 4:
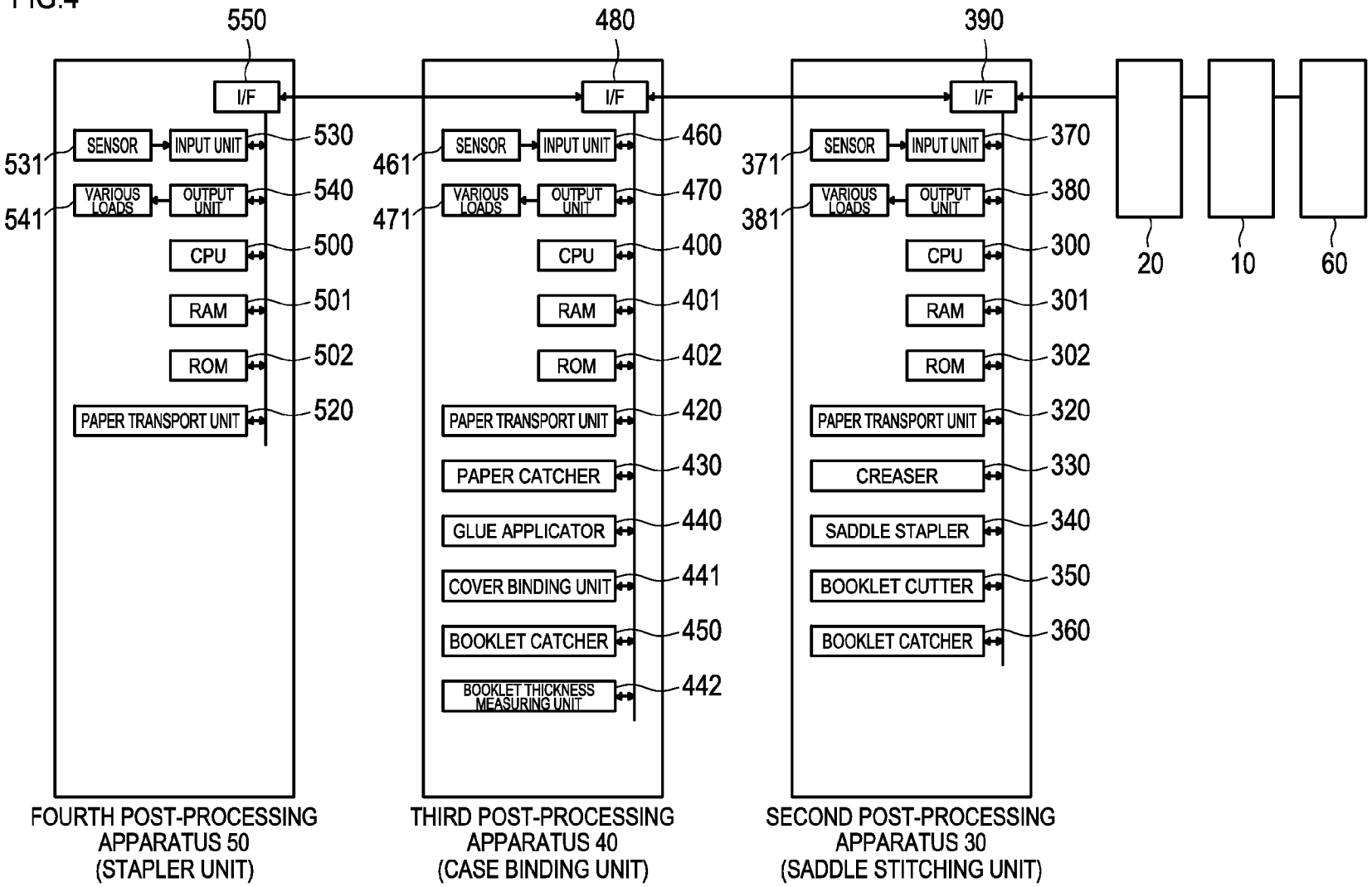
FIG. 4 is a diagram showing part of the functional blocks of the image forming system according to the embodiment of the present invention.

Next, functional blocks of the image forming system 1 will be described with reference to FIGS. 2 to 4.

First, the large-capacity paper unit 60 will be described.

An I/F 650, which is an interface adapted to exchange various types of information with an I/F 170 of the image forming apparatus 10, makes it possible to transmit information from the large-capacity paper unit 60 to the image forming apparatus 10 and perform a paper feed operation in response to a control command such as a paper feed command from the image forming apparatus 10.

A paper transport unit 620 is made up of the transport path 62, a transport roller (not shown), and the like and adapted to feed and transport paper from the paper feed trays 61 to the transport path 12 of the image forming apparatus 10.

Based on information sent from various parts of the large-capacity paper unit 60, a CPU 600 controls operation of the entire large-capacity paper unit 60. Also, the CPU 600 controls the large-capacity paper unit 60 in response to a control command from a CPU 100 of the image forming apparatus 10.

A RAM 601 provides an area to temporarily store programs or data needed when the CPU 600 controls the large-capacity paper unit 60.

A ROM 602 stores various programs or data and the CPU 600 controls the large-capacity paper unit 60 by reading programs or data out of the ROM 602.

An input unit 630, which is designed to receive various types of input information from a sensor 631 and transmit the information to the CPU 600, detects transported paper, for example, using the sensor 631 and transmits a detection result to the CPU 600. The input unit 630 can detect a start of paper feed and any paper jam.

An output unit 640, which is designed to output necessary drive voltages and the like to various loads 641, drives various loads such as the transport roller of the paper transport unit 620.

Next, the image forming apparatus 10 will be described.

The image forming apparatus 10 includes the image forming unit 110, a paper transport unit 120, the image scanner 130, the control panel 140, the CPU 100, the I/F 170, and the like.

The image scanner 130 reads image data of documents based on reflected light by illuminating a document fed by the automatic document feeder (ADF) 13 or a document placed on the glass platen with light from a light source (not shown).

The read image data is sent to the CPU 100 and stored in the RAM 101, an HDD (not shown), or the like.

An image density adjuster 111 adjusts density of the image data of the document read by the image scanner 130 or image data stored in the HDD (not shown), or the like. The image density can be adjusted automatically by the CPU 100 described later or by the user via the control panel 140.

The image forming unit 110 forms an image on paper based on the image data read by the image scanner 130 and subjected to image processing or image data acquired externally.

Possible methods for forming an image on paper include an electrophotographic method, inkjet method, laser printing method, and the like.

A slip paper insertion manager 113 manages slip paper inserted among papers. For example, the slip paper insertion manager 113 manages paper feed when cover paper are joined to a book body papers.

The paper transport unit 120, which includes the transport path 12 and transport roller, and the like, is a mechanism adapted to transport paper to the first post-processing apparatus 20.

A paper feed tray switching unit 121, which is a mechanism adapted to switch trays used to feed paper in image formation, allows paper to be fed by selecting a tray in the large-capacity paper unit 60 or selecting one of the paper feed trays 11 in the body.

The control panel 140 allows the user to enter various settings on image formation or post-processing with respect to paper. Then, based on details of the entered various settings, the image forming apparatus 10 forms an image on paper while other post-processing apparatus perform necessary post-processing on paper.

Also, the control panel 140 allows the user to enter information about a paper type and basis weight of paper. The control panel 140 can be configured as a combination of a display unit and control panel, and according to the present embodiment, a display unit and control panel are configured to be integrated into the LCD 14. Alternatively, a display unit can be provided separately from the control panel 140.

Based on information sent from various parts of the image forming apparatus 10, the CPU 100 controls operation of the entire image forming apparatus 10. Also, the CPU 100 can control the large-capacity paper unit 60, first post-processing apparatus 20, second post-processing apparatus 30, third post-processing apparatus 40, and fourth post-processing apparatus 50 by transmitting control commands thereto. That is, in the present embodiment, the CPU 100 functions as a controller according to the present invention. Note that when the post-processing apparatus according to the present invention is used stand-alone or the like, the controller can be configured by the CPU or the like equipped with the post-processing apparatus.

The RAM 101 provides an area to temporarily store programs or data needed when the CPU 100 controls the image forming apparatus 10. The HDD and the like store image data and the like read by the image scanner 130.

A ROM 102 stores various programs or data and the CPU 100 controls the image forming apparatus 10 by reading programs or data out of the ROM 102.

An input unit 150 receives various types of input information from a sensor 151 and transmits the information to the CPU 100.

For example, transported paper is detected by the sensor 151 and a detection result is transmitted to the CPU 100, allowing image formation timing and transport timing to be determined.

An output unit 160, which is designed to output necessary drive voltages and the like to various loads 161, drives various loads such as the transport roller of the paper transport unit 120 and a drive motor of the image forming unit 110.

The I/F 170, which is an interface adapted to exchange various types of information with the large-capacity paper unit 60 and first post-processing apparatus 20, can, for example, collect information from other apparatus and transmit control commands to the other apparatus. Also, the I/F 170 can communicate with the second post-processing apparatus 30, third post-processing apparatus 40, and fourth post-processing apparatus 50 via the first post-processing apparatus 20.

Next, the first post-processing apparatus 20 will be described.

An I/F 260 is an interface adapted to exchange various types of information with the I/F 170 of the image forming apparatus 10 and an I/F 390 of the second post-processing apparatus 30 described later.

The I/F 260 transmits information on the first post-processing apparatus 20 to the image forming apparatus 10 and receives control commands and the like from the image forming apparatus 10. Also, being interposed between the image forming apparatus 10 and post-processing apparatus in succeeding stages, the I/F 260 also functions as an interface to exchange various types of information between the post-processing apparatus in the succeeding stages and the I/F 170 of the image forming apparatus 10.

A paper transport unit 220, which includes the transport path 22 and a transport roller (not shown), and the like, transports the paper sent from the image forming apparatus 10 to the second post-processing apparatus 30 and stacks plural sheets of paper on the stacker 23. Also, the paper transport unit 220 transports a predetermined number of sheets of paper stacked on the stacker 23 to the second post-processing apparatus 30.

Based on information sent from various parts of the first post-processing apparatus 20, a CPU 200 controls operation of the entire first post-processing apparatus 20. Also, the CPU 200 operates on instructions from the CPU 100 of the image forming apparatus 10 and controls the first post-processing apparatus 20.

A RAM 201 provides an area to temporarily store programs or data needed when the CPU 200 controls the first post-processing apparatus 20.

A ROM 202 stores various programs or data and the CPU 200 controls the first post-processing apparatus 20 by reading programs or data out of the ROM 202.

An input unit 240, which is designed to receive various types of input information and transmit the information to the CPU 200, detects transported paper using a sensor 241 and transmits a detection result to the CPU 200. This makes it possible to detect paper transport, a stack of paper on the stacker 23, and the like.

An output unit 250, which is designed to output necessary drive voltages and the like to various loads 251, drives the transport roller of the paper transport unit 220 and the like.

Next, the second post-processing apparatus 30 will be described.

The I/F 390, which is an interface adapted to exchange various types of information with the I/F 260 of the first post-processing apparatus 20 and an I/F 480 of the third post-processing apparatus 40 described later, exchanges various types of information on the second post-processing apparatus 30 with the first post-processing apparatus 20, transmits information to the image forming apparatus 10 via the I/F 260, and receives control commands and the like from the image forming apparatus 10. Also, being interposed between the image forming apparatus 10 and post-processing apparatus in succeeding stages, the I/F 390 also functions as an interface to exchange various types of information between the post-processing apparatus in the succeeding stages and the I/F 170 of the image forming apparatus 10.

A paper transport unit 320, which includes the transport path 32 and a transport roller (not shown), can transport the paper sent from the first post-processing apparatus 20 to a post-processor in the second post-processing apparatus 30, and transport post-processed paper to the third post-processing apparatus 40 or transport the paper to the third post-processing apparatus 40 without post-processing. Also, the paper transport unit 320 can transport a formed booklet to a booklet catcher 360.

A creasing unit 330 is a device adapted to form a crease on paper. In the present embodiment, the creasing unit 330 corresponds to the first post-processor according to the present invention. The creasing unit 330 includes the paper turn-over unit 33A and creasing section 33B.

A saddle staple unit 340 is designed to saddle-staple paper. In the present embodiment, the saddle staple unit 340 is one of components which correspond to the second post-processor according to the present invention and is different from the first post-processor.

A booklet cutter 350 is equipped with a cutting blade and the like, and designed to cut off an edge of a paper bundle to align the edge after the paper bundle is compiled into a booklet by being folded in the middle and stapled by the saddle staple unit 340.

The booklet catcher 360 stacks booklets which have been folded in the middle and stapled and allows the booklets to be taken out of the second post-processing apparatus 30.

Based on information sent from various parts of the second post-processing apparatus 30, a CPU 300 controls operation of the entire second post-processing apparatus 30. Also, the CPU 300 operates on instructions from the CPU 100 of the image forming apparatus 10 and controls the second post-processing apparatus 30.

A RAM 301 provides an area to temporarily store programs or data needed when the CPU 300 controls the second post-processing apparatus 30.

A ROM 302 stores various programs or data and the CPU 300 controls the second post-processing apparatus 30 by reading programs or data out of the ROM 302.

An input unit 370, which is designed to receive various types of input information and transmit the information to the CPU 300, detects transported paper using a sensor 371 and transmits a detection result to the CPU 300.

An output unit 380, which is designed to output necessary drive voltages and the like to various loads 381, drives the transport roller of the paper transport unit 320 as well as drive units and the like of the creasing unit 330, saddle staple unit 340, booklet cutter 350, and the like.

Next, the third post-processing apparatus 40 will be described.

The I/F 480, which is an interface adapted to exchange various types of information with the I/F 390 of the second post-processing apparatus 30 and an I/F 550 of the fourth post-processing apparatus 50, exchanges various types of information on the third post-processing apparatus 40 with the second post-processing apparatus 30, transmits information to the image forming apparatus 10 via the I/F 390 and I/F 260, and receives control commands and the like from the image forming apparatus 10.

Also, being interposed between the image forming apparatus 10 and post-processing apparatus in the succeeding stage, the I/F 480 also functions as an interface to exchange various types of information between the fourth post-processing apparatus 50 and the I/F 170 of the image forming apparatus 10.

A paper transport unit 420, which includes the transport path 42 and a transport roller (not shown), can transport the paper sent from the second post-processing apparatus 30 to a post-processor in the third post-processing apparatus 40, and transport post-processed paper to the fourth post-processing apparatus 50 or transport the paper to the fourth post-processing apparatus 50 without post-processing. Also, the paper transport unit 420 can transport a formed booklet to a booklet catcher 450.

A paper catcher 430 stacks cover papers used in case binding and feeds them as cover papers at the time of case binding. Note that paper transported from the large-capacity paper unit 60 or image forming apparatus 10 can be used for the cover papers.

A glue applicator 440 is a mechanism adapted to apply glue to the spine part of the booklet in preparation for case binding.

A cover binding unit 441 is a mechanism which does case binding by covering a booklet with a cover paper after glue has been applied to the booklet.

The booklet thickness measuring unit 442 measures thickness of a booklet and thereby determines thickness of the spine part of the cover paper.

In the present embodiment, the glue applicator 440, cover binding unit 441, and booklet thickness measuring unit 442 described above are some of components which correspond to the second post-processor according to the present invention and are different from the first post-processor.

The booklet catcher 450 stacks case-bound booklets and allows the booklets to be taken out of the third post-processing apparatus 40.

Based on information sent from various parts of the third post-processing apparatus 40, the CPU 400 controls operation of the entire third post-processing apparatus 40. Also, the CPU 400 operates on instructions from the CPU 100 of the image forming apparatus 10 and controls the third post-processing apparatus 40.

A RAM 401 provides an area to temporarily store programs or data needed when the CPU 400 controls the third post-processing apparatus 40.

A ROM 402 stores various programs or data and the CPU 400 controls the third post-processing apparatus 40 by reading programs or data out of the ROM 402.

An input unit 460, which is designed to receive various types of input information and transmit the information to the CPU 400, detects transported paper using a sensor 461 and transmits a detection result to the CPU 400 for use in various types of control.

An output unit 470, which is designed to output necessary drive voltages and the like to various loads 471, drives the transport roller of the paper transport unit 420 as well as drive units and the like of the glue applicator 440, cover binding unit 441, and booklet thickness measuring unit 442.

Next, the fourth post-processing apparatus 50 will be described.

The I/F 550, which is an interface adapted to exchange various types of information with the I/F 480 of the third post-processing apparatus 40, exchanges various types of information on the fourth post-processing apparatus 50 with the third post-processing apparatus 40 in a preceding stage, transmits information to the image forming apparatus 10 via the I/F 480, I/F 390, and I/F 260, and receives control commands and the like from the image forming apparatus 10.

A paper transport unit 520, which includes a transport path and transport roller (neither is shown), transports the paper sent from the third post-processing apparatus 40 in the fourth post-processing apparatus 50 and discharges the paper to the bundle catcher 51 and paper output tray 52.

Based on information sent from various parts of the fourth post-processing apparatus 50, the CPU 500 controls operation of the entire fourth post-processing apparatus 50. Also, the CPU 500 operates on instructions from the CPU 100 of the image forming apparatus 10 and controls the fourth post-processing apparatus 50.

A RAM 501 provides an area to temporarily store programs or data needed when the CPU 500 controls the fourth post-processing apparatus 50.

A ROM 502 stores various programs or data and the CPU 500 controls the fourth post-processing apparatus 50 by reading programs or data out of the ROM 502.

An input unit 530, which is designed to receive various types of input information and transmit the information to the CPU 500, detects transported paper using a sensor 531 and transmits a detection result to the CPU 500.

An output unit 540, which is designed to output necessary drive voltages and the like to various loads 541 drives the transport roller of the paper transport unit 520 and the like.

Figure 5:
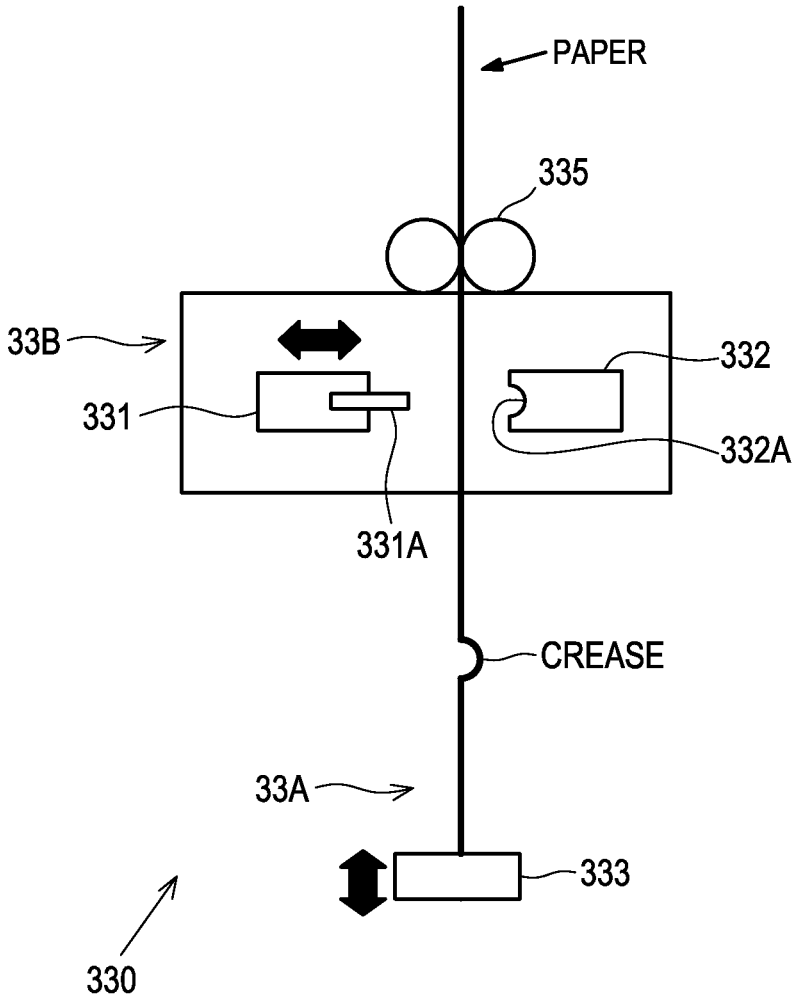
FIG. 5 is a diagram illustrating a creasing unit according to the embodiment of the present invention.

Next, details of the creasing unit 330 will be described with reference to FIG. 5.

The creasing unit 330 includes the paper turn-over unit 33A adapted to contain, turn over, and transport paper, and the creasing section 33B is provided on an inversion path of the paper turn-over unit 33A.

The creasing section 33B includes a line forming stand 332 located on one side of the paper introduced into the inversion path through a transport roller 335, and a line-forming/paper-folding knife 331 located on the other side of the paper. Furthermore, a tip stopper 333 is provided on the inversion path to determine a stop position of the paper by being hit by a tip of the paper introduced into the inversion path. The tip stopper 333 is configured to be movable along a transport direction of the paper allowing the stop position of the paper to be determined by the position of the tip stopper 333 and thereby making it possible to form a line at a desired position of the paper.

A line groove 332A for line forming is formed in the line forming stand 332, facing the introduced paper, and correspondingly a knife strip 331A is attached to the line-forming/paper-folding knife 331 on the other side of the introduced paper. The knife strip 331A is sized and shaped so as to be able to be inserted into the line groove 332A.

The line-forming/paper-folding knife 331 can move close to or away from the introduced paper and a line is formed on the paper as the line-forming/paper-folding knife 331 advances toward the paper and the knife strip 331A reaches inside the line groove 332A of the line forming stand 332. After a line is formed on the paper, the line-forming/paper-folding knife 331 moves backward, allowing the paper to be transported.

Also, when the stop position of the tip stopper 333 is changed, the stop position of the paper is changed as well when the tip of the paper moved by the transport roller 335 hits the tip stopper 333. As a result of the above operation, the line forming position on the paper is changed as well. Also, if the above operation is performed while changing the stop position of the tip stopper 333, a line can be formed at plural locations on the paper. The paper on which a line is formed is sent out from the inversion path and transported downstream with its front and back sides reversed from when introduced into the transport path.

Figure 6:
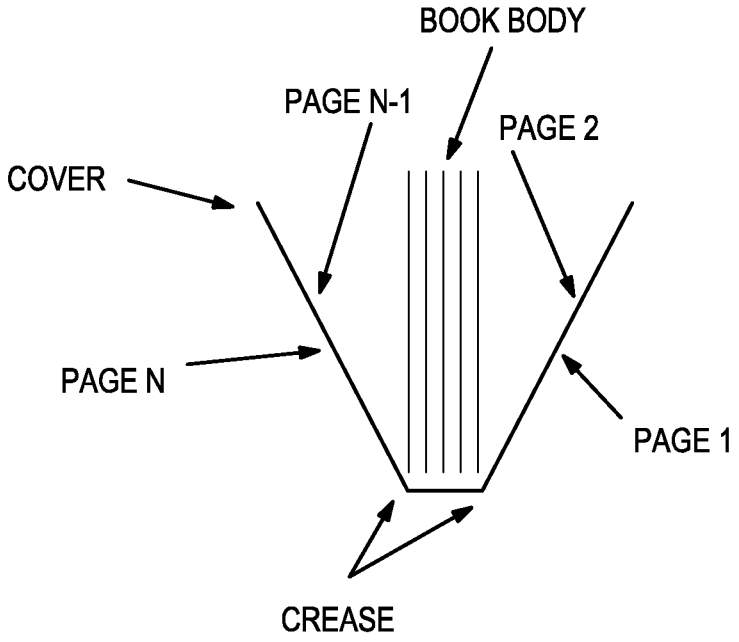
FIG. 6 is a diagram showing a relationship between a cover and book body at the time of case binding according to the embodiment of the present invention.

Note that the 1st and Nth pages of a case binding cover on which lines are formed need to be placed face down as shown in FIG. 6. When only one side of a cover paper is glossy, for example, if the user wants to use the glossy side of the paper for a cover, it is understandable that the user does not wish to reverse the front and back sides of the papers put in a cassette regardless of whether or not a creasing process is used.

Figure 7:
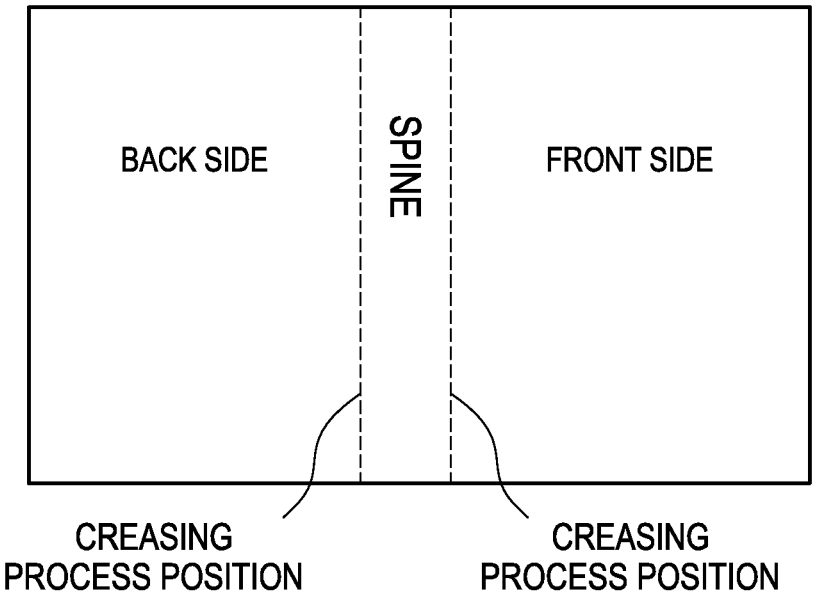
FIG. 7 is a diagram showing a sample of a case binding cover according to the embodiment of the present invention.

FIG. 7 shows a sample of a case binding cover. When a glossy side of paper differing in gloss between the front and back sides is used for a front cover and back cover, the paper is set in the paper feed tray such that a predetermined side will be creased.

However, when a post-processing setting is such that no creasing will be done, as described with reference to FIG. 5, the papers subjected to a creasing process is transported with their front and back sides reversed and the papers not subjected to a creasing process is transported without being turned over. Consequently, in case binding, papers differ between front and back sides depending on whether or not the papers are creased, and it is not possible to obtain outputs post-processed on the same side unless the papers are placed on different sides in the paper feed tray depending on whether or not the papers are creased.

Figure 8:
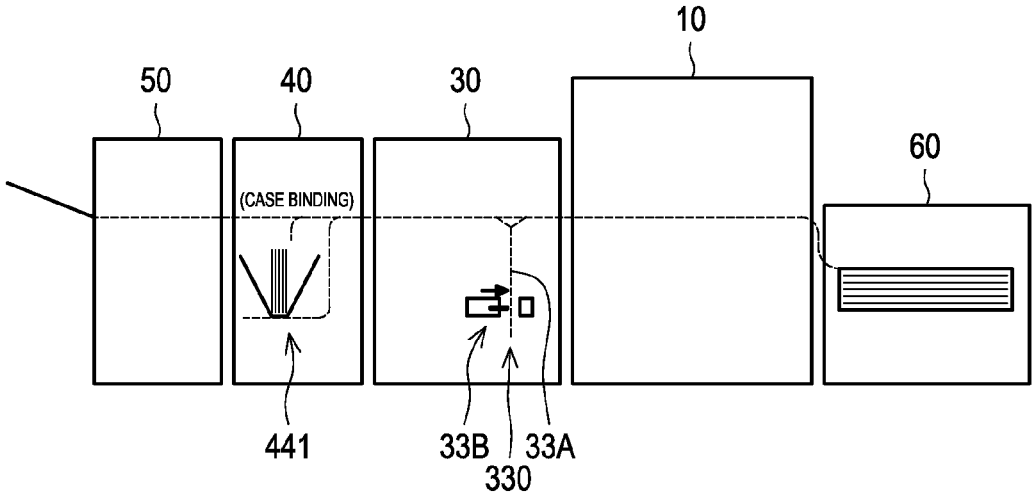
FIG. 8 is a diagram illustrating operation of the image forming system according to the embodiment of the present invention.

FIG. 8 is a diagram illustrating operation of an embodiment of the present invention. Note that the first post-processing apparatus 20 is omitted in FIG. 8.

When a case binding cover is fed from the large-capacity paper unit 60, if lines are to be formed on the case binding cover by the creasing unit 330, the paper is turned over by the paper turn-over unit 33A of the creasing unit 330.

On the other hand, if the papers are not turned over when not creased, the cover paper of the completed booklet switches sides depending on whether or not the papers are creased. For example, when the front side of the papers set in the large-capacity paper unit 60 is glossy and the back side is not glossy, if the papers are subjected to a creasing process, the glossy side of the booklet cover is located on an outer side of the booklet, but if the papers are not turned over when not creased, the glossy side of the booklet cover is located on an inner side of the booklet. When the user wants to compare the presence and absence of creases on a case binding cover, the user needs to go to the trouble of turning the papers in the large-capacity paper unit 60 upside down. Therefore, when there is a creasing unit, if a case binding cover is printed, the paper is always passed through the paper turn-over unit 33A of the creasing unit 330.

Figure 9:
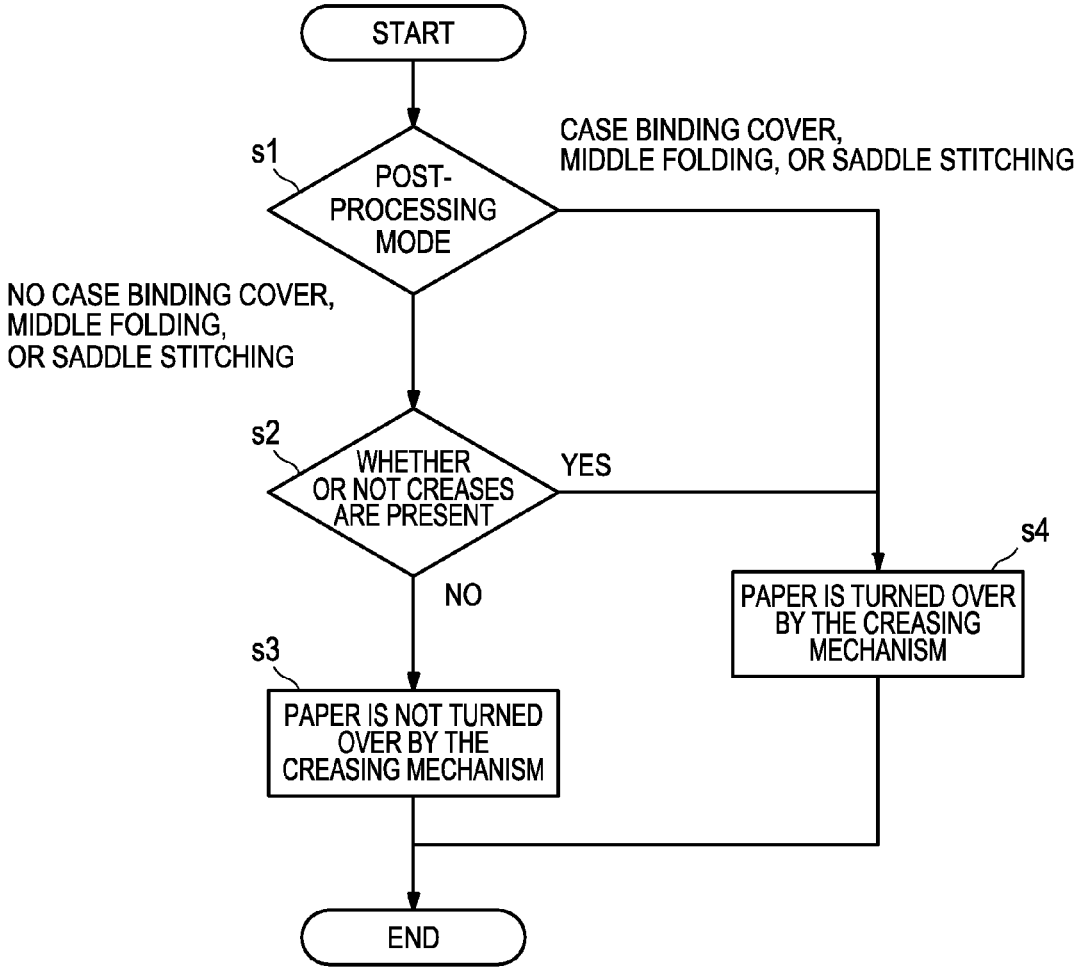
FIG. 9 is a flowchart showing procedures for determining whether or not a turn-over operation is performed by a first post-processor according to the embodiment of the present invention.

Next, procedures for determining, according to a post-processing mode, whether to use the paper turn-over unit in the first post-processor will be described with reference to a flowchart of FIG. 9. The following procedures are carried out under the control of the CPU 100 attached to the image forming unit.

When processing is started, the post-processing mode is determined (step s1).

In the determination, it is determined whether the mode is Case Binding Cover, Middle Folding, or Saddle Stitching, which include a folding process.

If the mode is any of case binding cover, middle folding, and saddle stitching (any of case binding cover, middle folding, and saddle stitching in step s1), the paper is turned over by the creasing mechanism regardless of the presence or absence of creases (step s4), and the process of the first post-processor is finished.

If the mode is none of case binding cover, middle folding, and saddle stitching (none of case binding cover, middle folding, and saddle stitching in step s1), it is determined whether or not creases are present (step s2). If creases are present (present in step s2), the paper is turned over by the creasing mechanism (step s4), and the process of the first post-processor is finished. If creases are absent (absent in step s2), the processing is finished without turning over the paper using the creasing mechanism.

Details and reasons of the above-described determination method are shown in Table 1.

A case binding cover needs to be placed face down on a case binding machine and has to be always turned over by the creasing mechanism such that the same side of the paper will always face the same direction regardless of the presence or absence of creases.

In the case of middle folding or saddle stitching, as with case binding cover, paper always has to be turned over by the creasing mechanism such that the same side of the paper will always face the same direction regardless of the presence or absence of creases.

In the case of straight stitching or side stitching, which does not include a folding process, a crease can be formed on any desired side of the paper by simply switching between Face-down and Face-up. In that case, different sides of the output face upward, but there is no problem because the user can turn over the output. The paper can also be turned over when no crease is provided, but turning over the paper will sometimes reduce productivity, and some creasing mechanisms have constraints on turn-over size.

TABLE 1

| MODE | WITHOUT CREASING | WITH CREASING | Reasons |
|---|---|---|---|
| Case binding cover | Turn-over | Turn-over | A case binding cover needs to be placed face down on a case binding machine. The paper is always turned over by the creasing mechanism such that the same side of the paper will always face the same direction regardless of the presence or absence of creases. |
| Middle folding/saddle stitching | Turn-over | Turn-over | The paper is always turned over by the creasing mechanism as with case binding cover. |
| Straight stitching | No turn-over | Turn-over | A crease can be formed on any desired side of the paper by simply switching between |
| Side stitching | No turn-over | Turn-over | Face-down and Face-up. In that case, different sides of the output face upward, but there is no problem because the user can turn over the output. The paper can also be turned over when no crease is provided, but turning over the paper will sometimes reduce productivity, and some creasing mechanisms have constraints on turn-over size. |

That is, when using an apparatus which includes a post-process provided with a paper turn-over unit as well as subsequent post-processes, the present embodiment makes it possible to easily obtain an output in which all papers are oriented in the same direction with their front side turned in one direction and their back side turned in the other direction as required and to use the paper turn-over unit only when necessary. This can minimize reduction in productivity.

Also, the present embodiment makes it possible to eliminate the inconvenience of turning the papers in the paper feed cassette upside down in order to orient the papers in the same direction with their front side turned in one direction and their back side turned in the other direction.

The present invention has been described by referring to the above embodiment, but alterations can be made as appropriate without departing from the spirit of the present invention.

What is claimed is:

1. A post-processing apparatus, comprising:

a first post-processor equipped with a paper turn-over unit for paper and a paper surface processing unit adapted to process a paper surface of the paper;

a second post-processor configured to be different from the first post-processor and located downstream of the first post-processor in a paper transport direction; and a controller adapted to control the first post-processor and the second post-processor, wherein the controller determines whether to use the paper turn-over unit of the first post-processor to turn over the paper, according to a combination of execution or non-execution of a first post-processing mode which uses the first post-processor and execution or non-execution of a second post-processing mode which uses the second post-processor, the execution or non-execution of the first and second post-processing modes being individually and selectively settable.

2. The post-processing apparatus according to claim 1, wherein after the paper surface of the paper has been processed by the paper surface processing unit, the first post-processor transports the paper downstream by reversing front and back sides of the paper using the paper turn-over unit.

3. The post-processing apparatus according to claim 1, wherein the paper surface processing unit is a creasing unit adapted to form a line on a front side of the paper.

4. The post-processing apparatus according to claim 1, wherein the second post-processor performs post-processing including folding of the paper.

5. The post-processing apparatus according to claim 4, wherein the second post-processor performs any of case binding cover, middle folding, and saddle stitching processes.

6. The post-processing apparatus according to claim 1, wherein when the second post-processor performs post-processing including the folding of the paper, the controller uses the paper turn-over unit regardless of whether the paper surface processing unit is operated, and when the second post-processor performs post-processing without including the folding of the paper, the controller uses the paper turn-over unit only when the paper surface processing unit is operated.

7. An image forming system comprising:

an image forming apparatus adapted to form an image on paper;

a first post-processor equipped with a paper turn-over unit for paper and a paper surface processing unit adapted to process a paper surface of the paper;

a second post-processor configured to be different from the first post-processor and located downstream of the first post-processor in a paper transport direction; and a controller adapted to control the first post-processor and the second post-processor, wherein the controller determines whether to use the paper turn-over unit of the first post-processor to turn over the paper, according to a combination of execution or non-execution of a first post-processing mode which uses the first post-processor and execution or non-execution of a second post-processing mode which uses the second post-processor, the execution or non-execution of the first and second post-processing modes being individually and selectively settable.

8. The image forming system according to claim 7, wherein after the paper surface of the paper has been processed by the paper surface processing unit, the first post-processor transports the paper downstream by reversing front and back sides of the paper using the paper turn-over unit.

9. The image forming system according to claim 7, wherein the paper surface processing unit of the first post-processor is a creasing unit adapted to form a line on a front side of the paper.

10. The image forming system according to claim 7, wherein the second post-processor performs post-processing including folding of the paper.

11. The image forming system according to claim 10, wherein the second post-processor performs any of case binding cover, middle folding, and saddle stitching processes.

12. The image forming system according to claim 7, wherein when the second post-processor performs post-processing including the folding of the paper, the controller uses the paper turn-over unit regardless of whether the paper surface processing unit is operated, and when the second post-processor performs post-processing without including the folding of the paper, the controller uses the paper turn-over unit only when the paper surface processing unit is operated.

* * * * *